United States Patent [19]

Lallemand

[11] 4,140,055

[45] Feb. 20, 1979

[54] AUTOMATIC DEVICE FOR THE VALUE-SETTING OF PRINTING WHEELS IN A FRANKING MACHINE

[75] Inventor: Jacques Lallemand, Paris, France

[73] Assignee: Societe d'Etude et de Construction d-Appareils de Precision (S.E.C.A.P.), Boulogne Billancourt, France

[21] Appl. No.: 803,735

[22] Filed: Jun. 6, 1977

[30] Foreign Application Priority Data

Jun. 9, 1976 [FR] France ..... 76 17330

[51] Int. Cl.[2] ..... B41L 47/46

[52] U.S. Cl. ..... 101/91; 101/92

[58] Field of Search ..... 101/77, 86, 91, 92, 101/101, 110, 99

[56] References Cited

U.S. PATENT DOCUMENTS

| | | | |
|---|---|---|---|
| 987,372 | 3/1911 | Johnston | 101/86 |
| 3,237,556 | 3/1966 | Huffman | 101/92 X |
| 3,327,941 | 6/1967 | Stnuffer | 101/91 |
| 3,455,237 | 7/1969 | Trab | 101/91 |
| 3,583,314 | 6/1971 | Gillender et al. | 101/91 |
| 3,768,402 | 10/1973 | Levesque et al. | 101/92 |
| 4,007,359 | 2/1977 | Ford | 101/91 X |

*Primary Examiner*—Edward M. Coven

*Attorney, Agent, or Firm*—McDougall, Hersh & Scott

[57] ABSTRACT

A device for setting the prepayment values of printing wheels in a machine for franking mail envelopes and wrappers comprises in the case of each printing wheel a mechanical planet-wheel transmission system in which an eccentrically mounted pinion is in mesh with a ring-gear within a franking drum. The ring-gear is rigidly fixed to an annular sliding disc which is freely rotatable on the drum and coupled thereto by means of a clutch. A retractable stop is capable of maintaining the clutch in the disengaged position as soon as the drum begins its movement of rotation for one revolution. The angular amplitude of rotation is predetermined in response to the position of a unit for controlling the prepayment value setting of the printing wheel considered.

4 Claims, 4 Drawing Figures

AUTOMATIC DEVICE FOR THE VALUE-SETTING OF PRINTING WHEELS IN A FRANKING MACHINE

This invention relates to franking machines of the type comprising printing wheels mounted in a rotary franking drum which is driven so as to make one revolution during each franking operation.

In machines of this type, the printing wheels are usually brought to their respective prepayment values by means of mechanical transmission system, either by means of sliders which may or may not rotate with the drum or by means of a mechanical keyboard of the type employed in cash registers.

In all cases, introduction of the payment values can only be manual and direct, thus giving rise to a number of drawbacks. In particular, the value-setting of the printing wheels must necessarily precede the movement of rotation of the franking drum, thus increasing the timeduration of a franking cycle to a certain extent. In the second place, the value-setting of the printing wheels cannot be controlled by means of an electronic keyboard or by means of a computer. And finally it is necessary to exert a certain effort in order to perform the value-setting operation.

The aim of the invention is to provide a device for the value-setting of printing wheels which is not attended by the above-mentioned disadvantages of known devices.

To this end and in accordance with the invention, the mechanical transmission system for setting the prepayment value of each printing wheel comprises a planet-wheel system with a pinion carried by a shaft which is mounted eccentrically within the franking drum and disposed in meshing engagement with a ring-gear. Said ring-gear is rigidly fixed to an annular sliding disc which is mounted to rotate freely on the drum and normally coupled to said drum by means of a clutch. A stationary retractable stop is capable in the active position of releasing the clutch when the drum and the sliding disc occupy a relative angular position of reference in which all the printing wheels are at zero and of maintaining the clutch in the disengaged position while the drum carries out a movement of predetermined amplitude from the beginning of its movement of rotation for one revolution. The amplitude of said movement is variable in response to the position of a unit for controlling the prepayment value setting of the printing wheel considered.

By means of a device of this type, the value-setting of the printing wheels and the control of the prepayment values are carried out at the beginning of the rotation of the drum for one revolution, that is to say within the franking cycle, and not during an additional stage which has to precede the rotation of said drum. The value-setting control unit can be remotely actuated, thus permitting the reception of orders derived from an electronic keyboard or from a computer without thereby calling for delicate positioning devices consisting, for example, of servo-motors incorporated in control systems. Finally, this device readily permits the possibility of associating counting means with the machine, either by means of an incorporated mechanical system or by means of an incorporated electronic systems, or else by means of an external electronic system which may or may not be a printing system.

A more complete understanding of the invention will be obtained from the following description and from the accompanying drawings in which one embodiment of an automatic device in accordance with the invention for the value-setting of printing wheels in a franking machine is shown by way of example without any limitation being implied, and in which.

Figure 1:
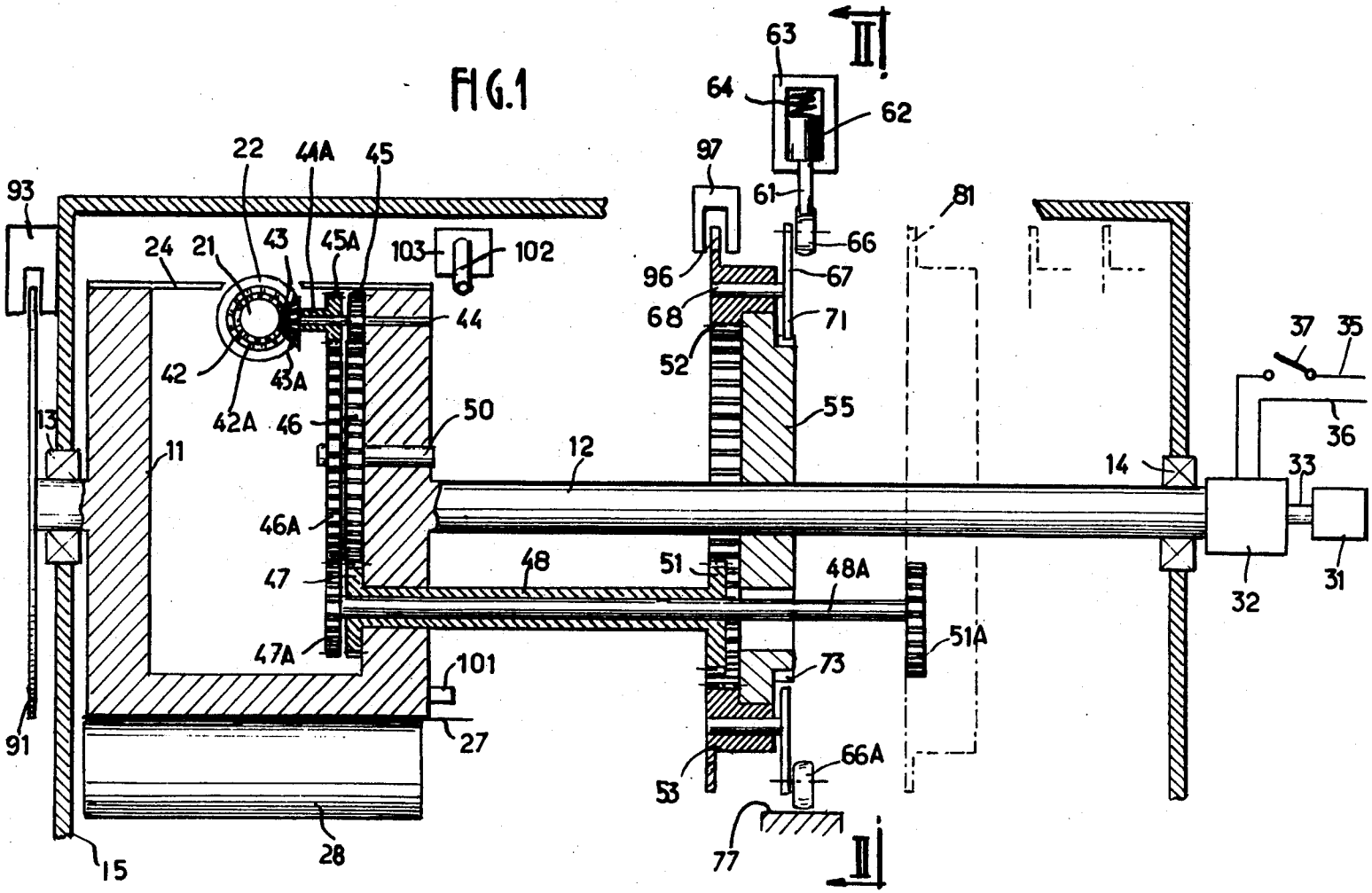
FIG. 1 is a longitudinal sectional view of the complete device.

The machine for franking mail envelopes and wrappers as illustrated in FIG. 1 comprises a franking drum 11 which is rigidly fixed to a shaft 12, said shaft being rotatably mounted in a frame 15 by means of two ball-bearings 13, 14.

The franking drum 11 carries a shaft 21 which is located at right angles to the shaft 12 and on which are loosely mounted printing wheels such as, for example, the wheel 22 for printing the units of the franking or prepayment values. By way of example, provision is made for three further printing wheels (not shown in the drawings for the sake of enhanced clarity) for printing the tens, hundreds and thousands of the prepayment values. There is formed in relief on each printing wheel such as, for example, the wheel 22, the series of ten digits 0, 1, 2, 3 . . . 8, 9. The periphery of the printing wheel projects to a slight extent with respect to the cylindrical surface of the franking drum 11 through a window 24 of said drum.

Figure 3:
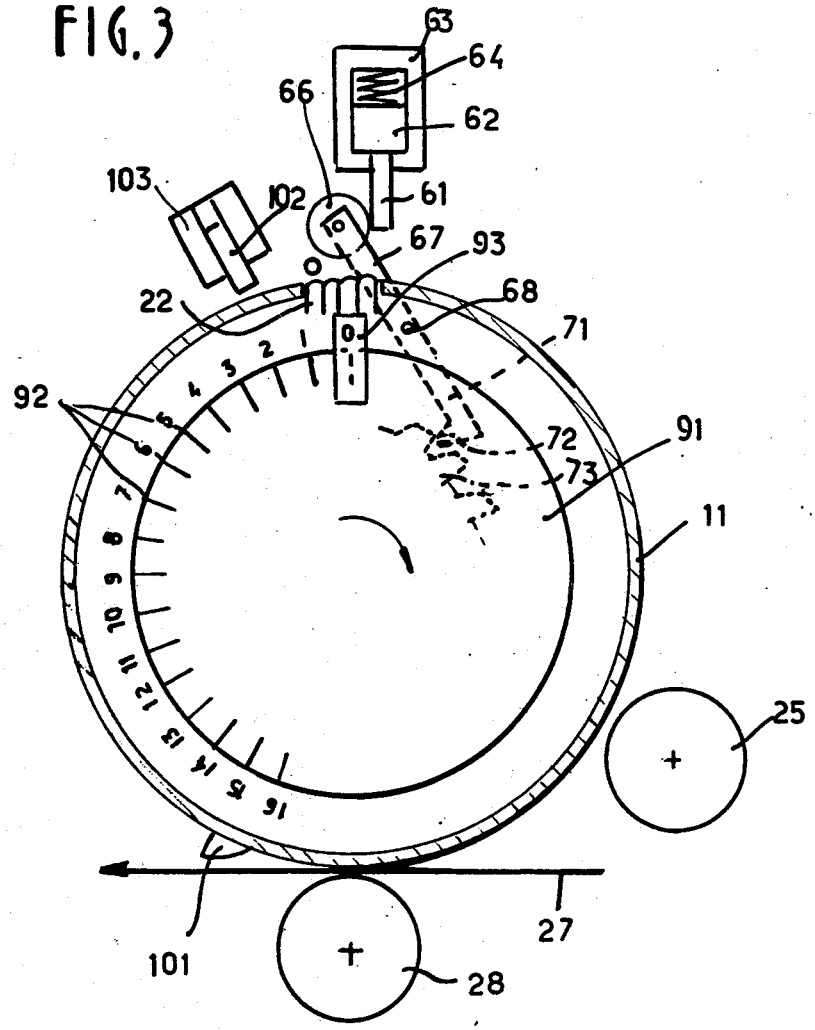
FIG. 3 is a view which illustrates the cooperation of certain essential elements of the device.

The system for inking the printing wheels is shown diagrammatically in the form of a simple inking roller 25 (see also FIG. 3). The envelope or wrapper 27 to be franked passes between the franking drum 11 and a pressure cylinder 28.

In order to carry out a franking operation on an envelope or wrapper 27, the drum 11 is caused to rotate for one revolution by means of any suitable conventional device as represented diagrammatically in the example by an electric reduction-gear motor 31. The shaft 12 of the franking drum is coupled to said electric motor by means of an electromechanical clutch 32 which interlocks the shaft of said drum and the output shaft 33 of the motor 31 for one revolution. The electromechanical clutch 32 is controlled for example by an electric circuit 35, 36 equipped with a pilot switching relay 37 which is actuated, for example, in response to the presence of an envelope or wrapper to be franked.

There will now be described the automatic device for angular positioning of the printing wheels for the value-setting of these latter. This device is the same in the case of each printing wheel and will therefore be described in detail only in the case of the device relating to the wheel 22 for printing the units of the prepayment values.

The printing wheel 22 is rigidly fixed to a bevel pinion 42 and this latter is actuated by a kinematic chain which comprises: a bevel pinion 43 in mesh with the bevel pinion 42, a shaft 44 which is rigidly fixed to the bevel pinion 43 and which rotates freely within the franking drum 11 about a geometrical axis which is parallel to that of the drum shaft 12, a spur-tooth pinion 45 fixed on the shaft 44, a spur-tooth pinion 46 in mesh with the spur-tooth pinion 45 and loosely mounted on a shaft 50 which is carried by the franking drum 11, a spur-tooth pinion 47 in mesh with the spur-tooth pinion 46 and rigidly fixed to a tubular shaft 48 which rotates freely within the franking drum 11 and which is parallel to the drum shaft 12, a planetary spur-tooth pinion 51 rigidly fixed to the tubular shaft 48, an internallytoothed ring-gear 52 in mesh with the planetary spur-tooth pinion 51 and rigidly fixed to an annular sliding disc 53, said disc being mounted to rotate freely on a carrier-plate 55 which is rigidly fixed to the shaft 12 of the franking drum.

Angular positioning of the printing wheel 22 is initiated by a relative movement of rotation between the franking drum 11 which carries said wheel and the annular disc 53 which is temporarily maintained stationary at the beginning of each revolution of the franking drum during a fraction of said revolution, the magnitude of which is a function of the value of the number to be printed on the envelope or wrapper to be franked by said printing wheel. This temporary retention is ensured by a stationary retractable stop constituted by a radial retaining-arm 61 which is rigidly fixed to the moving armature 62 of an electromagnet 63 carried by the frame 15 of the machine. When said electromagnet is not energized, a spring 64 maintains the retaining-arm 61 in a projecting position on the path of a loose roller 66 mounted at one end of a pawl lever 67 which pivots on a pin 68 carried by the annular disc 53. On the other side of the pin 68, the pawl lever 67 has an extension 71 terminating in a pawl tooth 72 which is capable of cooperating with a ratchet wheel 73. Said ratchet wheel is rigidly fixed to the carrier-plate 55 and has two sets of teeth displaced by one half-pitch with respect to each other. The pawl tooth 72 is urged elastically towards the ratchet wheel 73 by a spring 75, one end of which is attached to the carrier-plate 55 and the other end of which is attached to the extension 71 of the pawl lever 67. The amplitude of pivotal motion of the pawl-lever extension 71 in opposition to the force of the spring 75 is limited by a stop constituted by a stud 76 which is inserted in the annular sliding disc 53.

The carrier-plate 55 carries another pawl lever 67A which is identical with the pawl lever 67 and and mounted on a pin 68A which is diametrically opposite to the pivot-pin 68 of the pawl lever 67. The pawl lever 67A thus has an extension 71A with a pawl tooth 72A which also cooperates under the action of a spring 75A with the set of teeth of the ratchet wheel 73 which is opposite to the set of teeth with which the pawl tooth 72 cooperates whilst a roller 66A carried by the pawl lever 67A is thrust-back by a cam 77 which is rigidly fixed to the frame 15 of the machine while the roller 66 is retained by the retaining-arm 61 at the same time and in such a manner as to ensure that the two pawl teeth 72 and 72A are simultaneously disengaged from the ratchet wheel 73 solely in the angular reference or stand-by position shown in the drawing.

The wheel for printing the tens of the prepayment values (not shown in the drawings) is controlled by a similar device by means of an annular sliding disc 81 (as shown in FIG. 1), the arrangement of this latter being identical with that of the device which is associated with the annular sliding disc 53 and which has been described in the foregoing. A planetary spur-tooth pinion 51A is fixed on a shaft 48A which is mounted coaxially within the tubular shaft 48 and which also carries another pinion 47A disposed in meshing engagement with a pinion 46A. Said pinion 46A is loosely mounted on the shaft 50 and disposed in meshing engagement with a pinion 45A which is in turn fixed on a tubular shaft 44A. Said tubular shaft carries a bevel pinion 43A in mesh with another bevel pinion 42A which is rigidly fixed to said wheel for printing the tens.

The other two wheels for printing the hundreds and the thousands can be set at the requisite value in the same manner by means of similar devices comprising kinematic chains with additional tubular shafts around the shaft 44A and inside the shaft 48A which is also tubular in that case. These additional devices have not been illustrated for the sake of enhanced clarity of the drawings.

The shaft of the franking drum 11 also carries a coding wheel 91 having radial slits 92 which can be read by a photoelectric cell 93 which is rigidly fixed to the frame 15 of the machine. There are sixteen slits, ten of which are employed for value-setting of the printing wheels. The spacing of said slits corresponds exactly to the angular motion to be performed by the franking drum 11 in order to transfer a printing wheel 22 from one value to the next when the annular sliding disc 53 is retained by the retractable stop 61. Furthermore, perfect synchronization is ensured between the instant at which the photoelectric cell 93 reads a slit corresponding to a prepayment value and the instant at which the printing wheel 22 displays said value in a projecting position.

The periphery of the annular sliding disc 53 has a radial slit 96 which can be read by a detector 97 of any suitable and conventional type which is carried by the frame 15 of the machine and located at an angular distance from the slit 96 which is equal to the angular distance between two successive slits 92 of the coding wheel 91 when the annular sliding disc 53 occupies its angular reference position.

The printing drum 11 has a lug 101 (as shown in FIG. 3) which, for safety reasons which will be explained below in the course of the description relating to the operation of the machine, can be stopped if necessary during its passage by a retractable stop 102 which forms part of the moving armature of an electromagnet 103 carried by the frame 15 of the machine.

In broad outline, the operation of the machine is as follows:

For the purpose of franking an envelope or wrapper 27, the switch 37 is closed under the action of means which will be described below in order to engage the clutch 32 which initiates the rotation of the franking drum 11 for one revolution. When the franking drum occupies its angular reference position, the retaining arm 61 maintains the extension 71 of the pawl lever 67 against the stud 76 in opposition to the spring 75 whilst the diametrically opposite stationary cam 77 retains the extension 71A of the pawl lever 67A in opposition to the spring 75A and whilst the two teeth 72 and 72A are consequently disengaged from the ratchet wheel 73 which is rigidly fixed to the franking drum 11. As soon as said drum begins to rotate, each annular sliding disc such as, for example, the disc 53 relating to the units of the prepayment value is therefore secured against rotation by the corresponding retaining-arm 61. The relative movement of rotation between the franking drum 11 and the annular sliding disc 53 therefore causes the planetary spur-tooth pinion 51 to rotate within the ring-gear 52 which is accordingly stationary and consequently has the effect of driving the corresponding printing wheel 22 in rotation by means of the kinematic chain which was described earilier and comprises the shaft 48, the pinions 47, 46, 45, the shaft 44 and the pinions 43 and 42.

At the precise moment when the number of the desired prepayment value carried by the printing wheel 22 is located in the printing position, which corresponds to transfer of a corresponding number of slits 92 of the coding wheel 91 read by the photoelectric cell 93, the electromagnet 63 is energized (under the action of means which will be described below) and the retractable stop 61 is withdrawn, thus releasing the pawl lever 67 whilst the spring 75 ensures the engagement of the tooth 72 within a corresponding tooth-trough of the ratchet wheel 73. From that moment, the annular sliding disc 53 is made fast for rotation with the franking drum 11 and therefore begins to rotate with this latter. As soon as the roller 66A carried by the pawl lever 67A and extension 71A moves away from the stationary cam 77, the tooth 72A also begins to engage with a corresponding tooth-trough of the ratchet wheel 73, the operation being possible by virtue of the displacement by one half-pitch which exists between the two sets of teeth of the ratchet wheel 73.

The same succession of operations takes place in the case of each of the four printing wheels with amplitudes of motion which are a function of the different numbers of the prepayment value.

After rotation of the franking drum 11 through a sufficiently large angle to ensure that all the printing wheels have been able to occupy their angular position corresponding to the prepayment value, said printing wheels pass against the inking device 25, then print the prepayment value on the envelope or wrapper 27 against the pressure cylinder 28.

On completion of this printing operation, the retractable stop or retaining-arm 61 has returned to its initial projecting active position and retains the pawl lever 67A which is diametrically opposite to the pawl lever 67. This has the effect of stopping the annular sliding discs 53 and of initiating the rotation of the printing wheels 22. The stationary cam 77 extends over a sufficient distance to thrustback the pawl lever 67 sufficiently early to ensure that the tooth 72 is also disengaged from the ratchet wheel 73 as in the case of the tooth 72A. This movement continues until the drum has performed one complete and precise revolution as defined by the clutch system 32 for one revolution. In this position, the printing wheels 22 have returned to zero. The machine is in readiness for a further franking cycle.

In accordance with a design feature, the angle through which the annular sliding disc 53 is intended to rotate with respect to the franking drum 11 in order to ensure that the printing wheels each return to display the same number is an exact fraction of one half-revolution of the drum (90°, for example). Display of the values can therefore take place indifferently by means of either of the two pawl levers 67 or 67A which are therefore utilized in alternate sequence. The same applies to zero-resetting of the printing wheels.

From the point of view of operational safety of the machine and apart from the fact that a system can be provided for the entry of data into a computer, it will be noted that the structural design of the machine permits continuation of a cycle and consequently effective franking only if the value displayed by the printing wheels 22 is in fact identical with the value which is remote-controlled by withdrawal of the retaining-arms 61 at the proper time. This may not necessarily be the case, either by reason of the fact that withdrawal of a retaining arm 61 has not taken place or by reason of the fact that the tooth 72 of the extension of the pawl lever 67 has not fallen back against the ratchet wheel 73. It can in fact be assumed that, if these two results are achieved, the annular sliding disc 53 is temporarily secured to the carrier-plate 55, that is, to the franking drum 11. In point of fact, the structural design of the machine makes it possible to check whether the relative movement of rotation of the sliding disc 53 and of the franking drum has in fact begun at the correct instant. If "N" designates the remotecontrolled prepayment value and if coincidence is established between the instant of reading of the slit "N+1" of the coding wheel 91 and the instant of reading of the slit 96 of the sliding disc 53, the franking operation proceeds to completion since the unlocking electromagnet 103 initiates withdrawal of the stop 102 just before the lug 101 of the drum passes. On the contrary, if this coincidence is not achieved, the franking drum 11 is arrested by the stop 102 which has not withdrawn. This locking operation has taken place well before the printing wheels have reached the position of franking of the envelope and before the counting operation has been able to take place.

Figure 2:
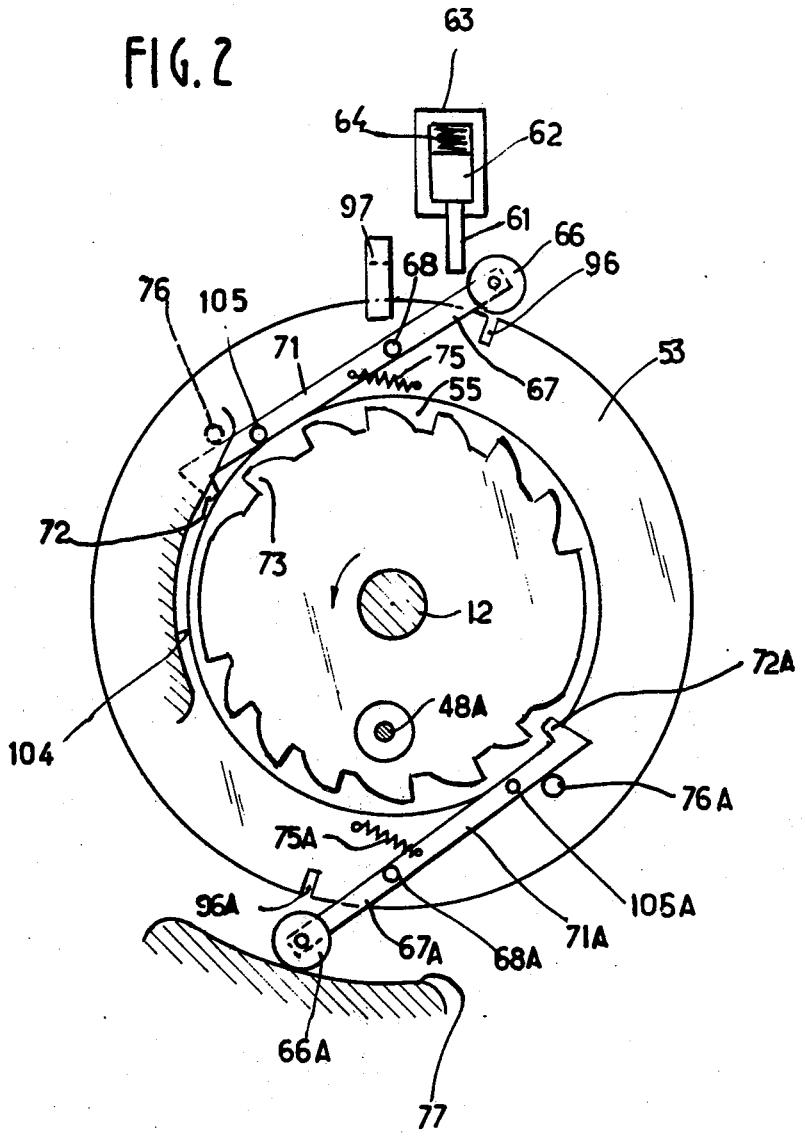
FIG. 2 is a transverse sectional view taken along line II—II of FIG. 1.

An additional device prevents the tooth 72 of the pawl lever 67 from escaping from the ratchet wheel 73; this additional device comprises a stationary cam 104 (as shown in FIG. 2) which is coaxial with the shaft 12 and a roller 105 which is loosely mounted on the pawl-lever extension 71. The position and length of said cam are such that this latter acts in opposition to any backward movement of the roller so as to prevent disengagement of the tooth 72 from the ratchet wheel 73 as long as the printing operation has not been completed. The other pawl-lever extension 71A carries an identical roller 105A.

Figure 4:
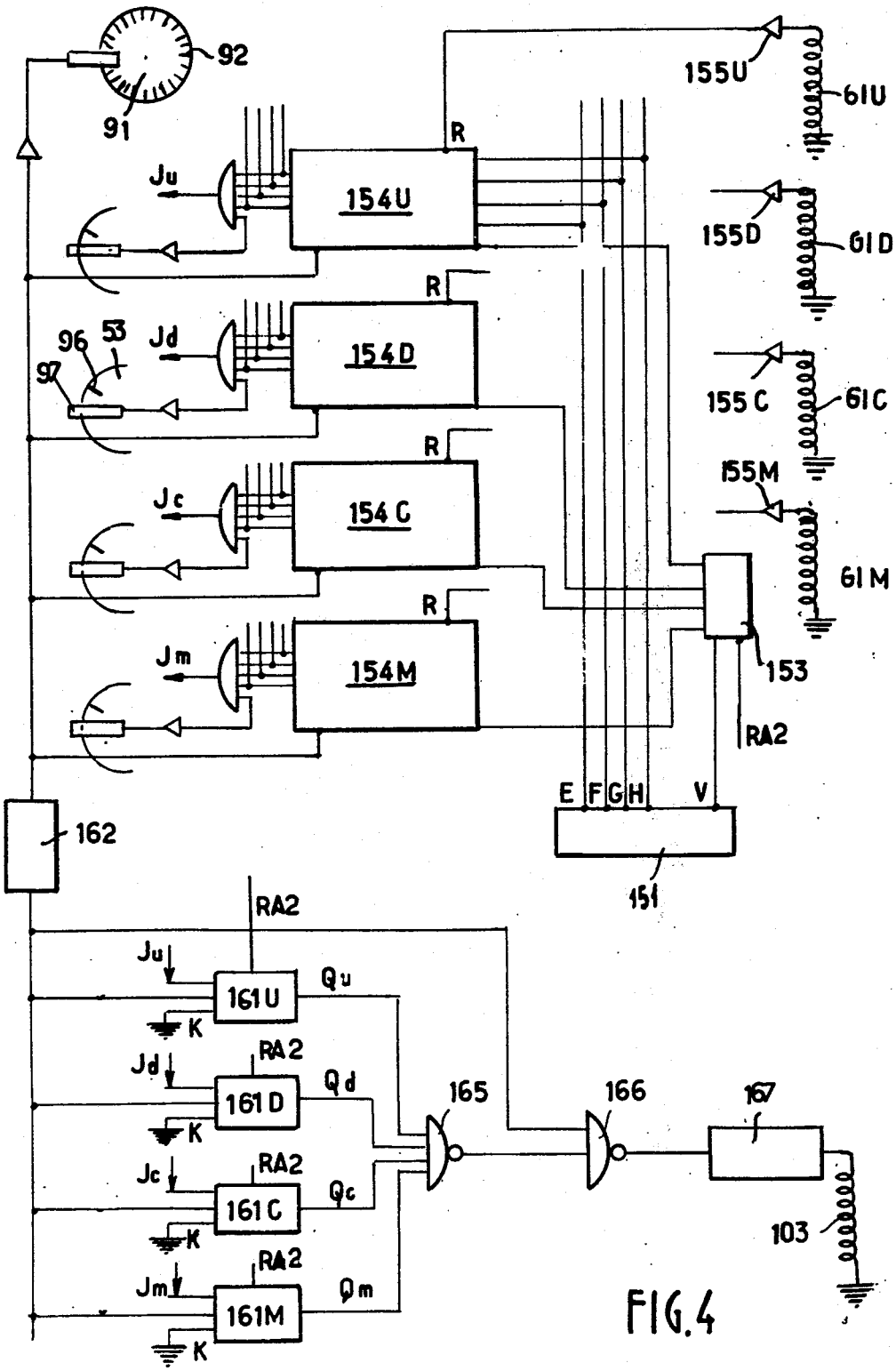
FIG. 4 is a simplified diagram of an electronic control system of the automatic device for value-setting of the printing wheels by means of a keyboard.

Referring now to FIG. 4, the logic circuits for initiating and controlling the positioning of the franking wheels at the desired values will now be described.

The unit for controlling the value-setting of the printing wheels consists of an electric keyboard 151 so designed as to deliver two indications after each key-operation. Said indications are present simultaneously at the output of said keyboard and are as follows:

(a) A binary coded decimal number on four terminals EFGH (parallel outputs). This number corresponds to the units (for example) to be introduced into the franking machine. In the case of each of the other three printing wheels, it would be necessary to have another set of four binary bits in order to permit the possibility of entering the values of the tens, the hundreds and the thousands respectively as a result of successive key-operations.

(b) An enabling signal of a fifth terminal V.

The enabling signal drives a logical switch 153 having four outputs which controls the "loading" inputs of four bidirectional counters (4 binary bits) 154U, 154D, 154C, 154M corresponding respectively to the units, tens, hundreds and thousands.

The binary coded decimal (BCD) number received at the terminals EFGH is fed into the corresponding counter 154U in accordance with the corresponding position of the switch 153 which is activated by each enabling signal.

As soon as the franking drum 11 rotates, the coding wheel 91 emits pulses which are employed for the counting-down operation of all the counters which have previously been loaded. As soon as a counter has returned to zero, this latter produces a retaining pulse "R". After passing through a corresponding amplifier 155U, 155D, 155C, 155M, said pulse serves to energize the corresponding electromagnet 61U, 61D, 61C or 61M for actuating the retaining-arms such as the arm 61 of FIG. 1 in order to release the sliding disc for actuating the printing wheels. Moreover, the BCD output which is displayed during the additional counting-down pulse emitted by the following slit 92 of the coding wheel 91 has only "1" bits on the four channels. This is also the state of the channel originating from the transducer 97 since the slit 96 is intended to be detected at the same time as the slit "N+1" of the slits 92 of the coding wheel 91 when the slit "N" of said wheel has resulted in coupling of the sliding disc 53 to the franking drum. The output BCD signal of the bidirectional counter 154U and the signal delivered by the transducer 97 are transmitted to an AND-gate which is designated in the diagram by the reference 157U.

The signal Ju which passes out of the gate 157 is in the state "1" only when time coincidence exists between the slit "N+1" of the coding wheel 91 and the single slit 96 of the sliding disc 53, where "N" designates the number to be introduced in the "units" printing wheel. In other words, the signal "Ju" is in the state "1" when mechanical positioning of the "units" printing wheel 22 is achieved with certainty.

The fact that all signals Ju, Jd, Jc, Jm have in fact passed through the value "1" during transfer of the slits 92 of the coding wheel 91 is stored in flip-flops 161U, 161D, 161C, 161M (one per decade) of the "J-K" type with grounded input K. To this end, said flip-flops are provided with a clock input fabricated from a detector 162 for detecting the presence of the slits 92 of the coding wheel 91. When this state is checked, the outputs Qu, Qd, Qc and Qm of the four flip-flops 161U, 161D, 161C 161M are all in state "1" and are transmitted through two "NAND" gates designated by the references 165, 166 to a shaping and amplifying device 67, the output signal of which serves to energize the release electromagnet 103. Franking is accordingly carried on to completion in the manner which has been set forth in the foregoing.

The four-position switch 153 as well as the flip-flops 161U, 161D, 161C, 161M are equipped with reset means for return to zero (R.Z.).

If the disc 91 has sixteen slits 92, the BCD outputs are again identical with the initial inputs after sixteen countdown pulses. In view of the fact that all the checking operations mentioned above have been completed, this makes it possible to introduce said BCD outputs into an electronic integrating counter which can perform the function of general counter for the machine if so required.

The invention is clearly not limited to the embodiment hereinabove described with reference to the accompanying drawings. Depending on the applications which are contemplated, modifications can accordingly be made without thereby departing either from the scope or the spirit of the invention.

We claim:

1. In a rotary franking drum having an axially extending shaft and a plurality of individual printing wheels each of which is rotatable relative to said drum and movable therewith about said shaft in a common direction of rotation, and means for driving said drum through said shaft in such a manner that said drum effects during each cycle of franking operation a full revolution from a reset position of the drum, a device for setting the postage value required to be printed by said printing wheels, said device comprising for each individual printing wheel:

(a) a ratchet wheel (55) mounted on said shaft (12) of the franking drum (11) for rotation therewith, said drum passing during its first half-revolution through a plurality of successive angular positions corresponding each to a predetermined value;

(b) an internally toothed annular wheel (53) concentric with said ratchet wheel and mounted for free rotary motion relative thereto;

(c) two pawls (71, 71A) mounted on said annular wheel for pivotal motion between a position in which said pawls engage with said ratchet wheel at two diametrically opposite points thereof, and a position in which said pawls are disengaged from said ratchet wheel;

(d) spring means (75, 75A) associated with each pawl for urging the same towards its engaged position thereof;

(e) an abutment member (61) shiftable between an inoperative position in which it lies outside the arcuate path described by said pawls when the latter are in engagement with the ratchet wheel during rotation thereof, and an operative position in which it lies within said path to cause that one of said two pawls which comes into contact with said abutment member to pivot towards its disengaged position and to remain in its disengaged position in which it locks said annular wheel against rotation when the drum is in its rest position;

(f) stationary cam means lying outside of said drum in diametrically opposite relation with said abutment member, said cam means presenting an operative concave surface (77) engageable by said pawls so as to cause one of said pawls to pivot towards its disengaged position shortly before the other pawl comes into contact with said abutment member;

(g) resilient means (64) for urging said abutment member towards said operative position thereof;

(h) an electrical control for emitting a transistory signal at the time the drum passes through the angular position which corresponds to the valve selected for said printing wheel;

(i) means (63) for shifting said abutment member towards its inoperative position against the action of said resilient means in response to said transitory signal; and (j) rotary means in mesh with said annular wheel for transmitting the angular movement thereof to the printing wheel in such a manner that the printing wheel reaches at the end of each franking cycle the same angular position in which it was at the beginning of said cycle.

2. A device according to claim 1, wherein said signal responsive means consists of an electromagnet (63) effective, when energized, to shift said abutment member towards said inoperative position thereof, and wherein said electronic control system comprises a numeric input keyboard encoder (151), a pulse generator including a disc (91) rotating in unison with said drum and provided with radial scanning slits (92) so circumferentially spaced from each other that the distance between the successive slits corresponds to an angle of rotation of one pitch of the printing wheels, and a photo-electric cell (93) which receives the required exciter light through said scanning slits, a bidirectional counter (such as 154 U) which receives, on the one hand, the numeric characters produced by said keyboard encoder in accordance with the selected franking values and, on the other hand, the series of pulses produced by said pulse generator during a portion of the first half-revolution of the drum, and means for the comparison of said numeric characters and said series of pulses in order to energize said electromagnet in accordance with the particular angular drum position corresponding to the selected franking value.

3. A device according to claim 2, further comprising a radial slit in each annular internally toothed wheel, a device for reading the slit, said device being located downstream of said slit at an angular distance equal to the angular distance between two successive scanning slits of the pulse generator disc when the annular wheel is retained by said abutment member, a device for sensing the coincidence between the detection of said slit by said reading device and the detection of a corresponding pulse produced by said pulse generator and a security stop mounted for movement between one position normally locking the franking drum against rotational movement and an inactive position responsive to the establishment of coincidence.

4. A device as claimed in claim 1 in which the ratchet wheel is formed by a smaller diameter portion of a disc member mounted on the shaft of the rotary drum for rotational movement therewith, the annular wheel being mounted on a larger diameter portion of said disc member for free rotational movement relative thereto.

* * * * *